US007458327B1

(12) United States Patent
Dunkerson

(10) Patent No.: US 7,458,327 B1
(45) Date of Patent: Dec. 2, 2008

(54) PLANING PONTOON BOAT HULL

(75) Inventor: William E. Dunkerson, Edgemont, AR (US)

(73) Assignee: Shiloh Holdings, LLC, Greers Ferry, AR (US)

( * ) Notice: Subject to any disclaimer, the term of this patent is extended or adjusted under 35 U.S.C. 154(b) by 0 days.

(21) Appl. No.: 11/726,476

(22) Filed: Mar. 22, 2007

(51) Int. Cl.
*B63B 1/00* (2006.01)
*B63B 1/10* (2006.01)
*B63B 1/20* (2006.01)

(52) U.S. Cl. ..... 114/61.1; 114/283; 114/292; 114/61.2; 114/61.27

(58) Field of Classification Search ..... 114/271, 114/283–292, 61.1–63, 39.25, 39.26–39.31; D12/300, 304, 309–314, 324; 244/105–107
See application file for complete search history.

(56) References Cited

U.S. PATENT DOCUMENTS 3,064,611 A 11/1962 Engle ..... 114/66.5
3,131,665 A * 5/1964 Kiekhaefer ..... 114/283
3,299,847 A * 1/1967 Bertholf ..... 114/266
3,438,350 A * 4/1969 Gallin ..... 114/61.3
3,675,605 A * 7/1972 Knerr ..... 114/61.21
4,031,841 A 6/1977 Bredt ..... 114/67
4,083,320 A 4/1978 Yost ..... 114/271
5,184,561 A 2/1993 Nickell, Jr. ..... 114/61
5,365,869 A 11/1994 Bulgarini ..... 114/61
5,619,944 A 4/1997 Baker ..... 114/61
5,676,087 A 10/1997 Baker ..... 114/283
5,718,184 A 2/1998 Holland ..... 114/271
5,911,187 A * 6/1999 Sohm ..... 114/61.1
6,085,677 A * 7/2000 Bell ..... 114/61.1

FOREIGN PATENT DOCUMENTS

JP 63291788 A * 11/1988

* cited by examiner

*Primary Examiner*—Ajay Vasudeva
(74) *Attorney, Agent, or Firm*—Keisling Pieper & Scott PLC; David B. Pieper; Trent C. Keisling

(57) ABSTRACT

A planing pontoon hull is described including a bow section with separate steep and shallow bow planes separated by left and right displacement guides extending upward from a planar bottom. Forward bow angle, steep deflections angles, displacement angles, and shallow planing angles are described for water movement over a range of water speeds and depths.

7 Claims, 2 Drawing Sheets

PLANING PONTOON BOAT HULL

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in pontoon hulls. More particularly, the invention relates to an improved planing pontoon hull.

2. Description of the Known Art

As will be appreciated by those skilled in the art, boat and pontoon hulls are known in various forms. Hull shapes for boats can be generally characterized as displacement, semi-displacement, planing, and multiple hull designs. Displacement hulls move water to the side without exhibiting lift characteristics. Lift is the force that enables forward thrust to push the hull up out of the water to decrease water contact and increase speed. Semi-displacement hulls partially deflect water and partially lift out of the water as forward thrust is increased. Planing hulls have almost no water displacement but generate significant lift from the forward thrust to reduce water contact. Multiple hull boats have a central connection system to span multiple parallel hulls to increase the available deck area. Multiple hull boats generally have exceptional stability in rough water as a result of a large beam/length ratio. Prior-art pontoon boats are known with hull shapes having U-shape, circular, octagonal or rectangular cross sections. Pontoon boats of the prior art generally have poor planing capabilities with little or no lift generated by the pontoons.

Patents disclosing information relevant to boat hulls include: U.S. Pat. No. 3,064,611, issued to Engle on Nov. 20, 1962; U.S. Pat. No. 3,131,665, issued to Kiekhaefer on May 5, 1964; U.S. Pat. No. 4,031,841, issued to Bredt on Jun. 28, 1977; U.S. Pat. No. 4,083,320, issued to Yost on Apr. 11, 1978; U.S. Pat. No. 5,184,561, issued to Nickell on Feb. 9, 1993; U.S. Pat. No. 5,365,869, issued to Bulgarini on Nov. 22, 1994; U.S. Pat. No. 5,619,944, issued to Baker on Apr. 15, 1997; U.S. Pat. No. 5,676,087, issued to Baker on Oct. 14, 1997; and U.S. Pat. No. 5,718,184, issued to Holland on Feb. 17, 1998. Each of these patents is hereby expressly incorporated by reference in their entirety.

U.S. Pat. No. 3,064,611, issued to Engle on Nov. 20, 1962 is directed to a break and press manufacturing process in which top and bottom formings combine with flat nose pieces to make a nose of a pontoon.

U.S. Pat. No. 3,131,665, issued to Kiekhaefer on May 5, 1964 is directed to the application of a detachable nose piece for a pontoon boat to facilitate easier movement of the device through the water.

U.S. Pat. No. 4,031,841, issued to Bredt on Jun. 28, 1977 is directed to an air lifting hull.

U.S. Pat. No. 4,083,320, issued to Yost on Apr. 11, 1978 is directed to a displacement hull.

U.S. Pat. No. 5,184,561, issued to Nickell on Feb. 9, 1993 is directed to the application of strakes to the side of a pontoon.

U.S. Pat. No. 5,365,869, issued to Bulgarini on Nov. 22, 1994 is directed to a high speed catamaran hull.

U.S. Pat. No. 5,619,944, issued to Baker on Apr. 15, 1997; and U.S. Pat. No. 5,676,087, issued to Baker on Oct. 14, 1997 are directed to trimarine hulls with skies.

U.S. Pat. No. 5,718,184, issued to Holland on Feb. 17, 1998 is again directed to a displacement hull.

These patents fail to teach the advantages of the integrating planing and displacement pontoon hull of the present invention. The basic problems of high speed efficient planing operation with co-extensive hull volume and the ability for efficient slow speed displacement is not taught by the prior art. Thus, it may be seen that these prior art patents are very limited in their teaching and utilization, and an improved planing pontoon hull is needed to overcome these limitations.

SUMMARY OF THE INVENTION

The present invention is directed to an improved planing pontoon boat. In accordance with one exemplary embodiment of the present invention, a pontoon hull is provided using a bow section defining a forward split edge with both a left and right steep bow plane and left and right displacement guides above a bottom shallow bow plane. This embodiment allows for efficient planing operations of the boat without hampering shallow water operation or low speed water displacement operation and control of the pontoon boat.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
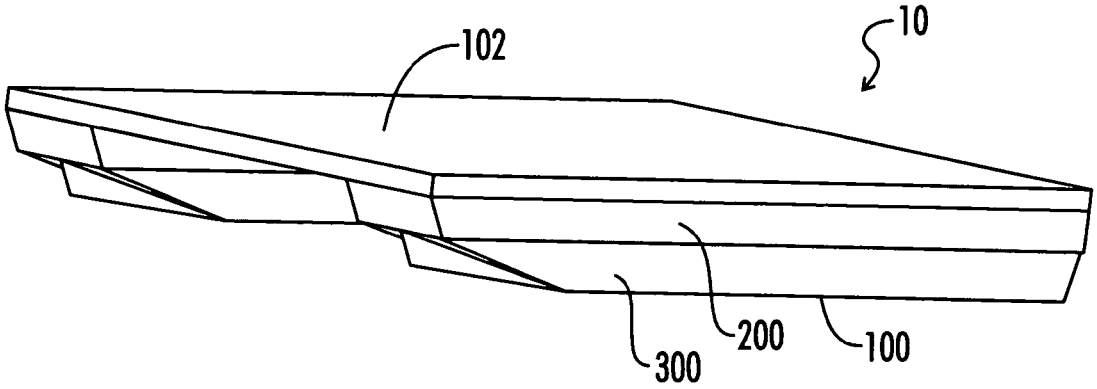
FIG. 1 is an isometric view of a pontoon boat deck using the planing hulls of the present invention.
Figure 2:
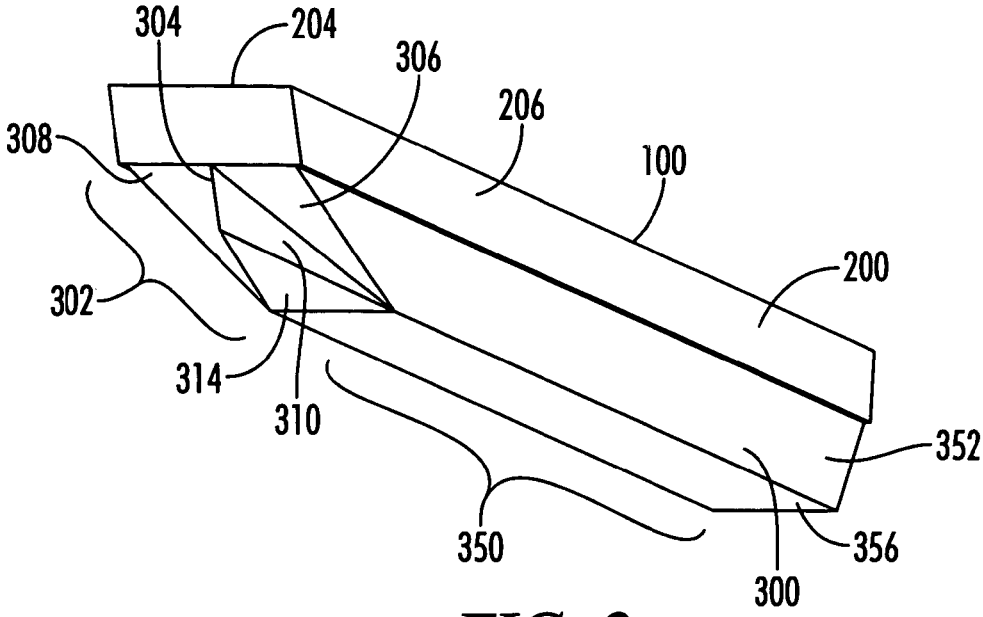
FIG. 2 is a lower right view of the planing pontoon hull.
Figure 3:
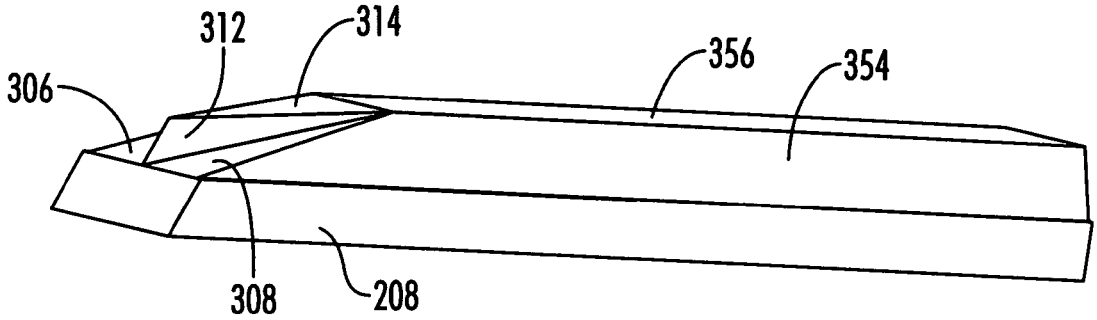
FIG. 3 shows the pontoon hull rotated upside down with the forward split edge, sharp and shallow planing surfaces and displacement sides.
Figure 4:
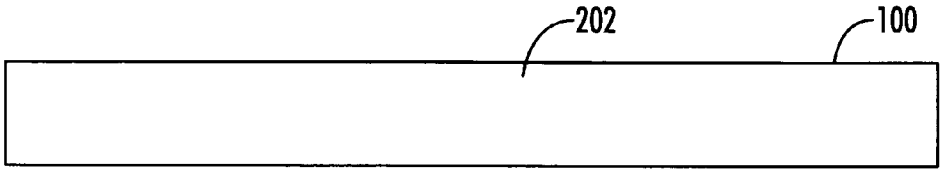
FIG. 4 is a top view of the planing pontoon hull.
Figure 6:
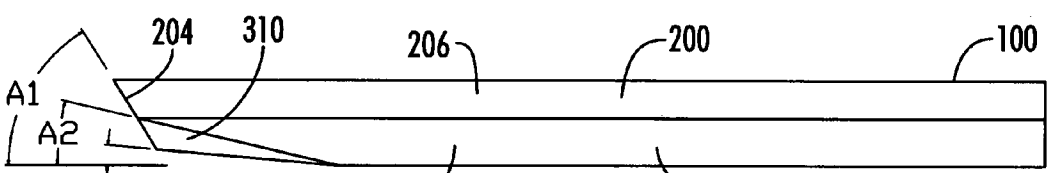
FIG. 6 is a right side view of the planing pontoon hull.
Figure 5:
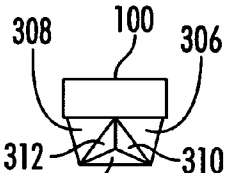
FIG. 5 is a front view of the planing pontoon hull.
Figure 8:
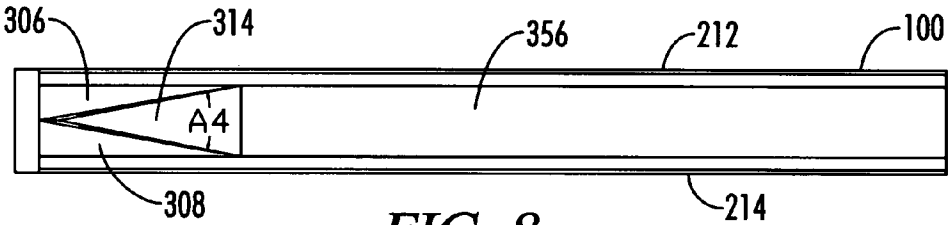
FIG. 8 is a bottom view of the planing pontoon hull.
Figure 7:
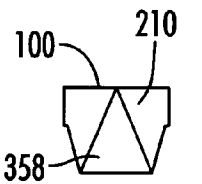
FIG. 7 is a back view of the planing pontoon hull.
Figure 9:
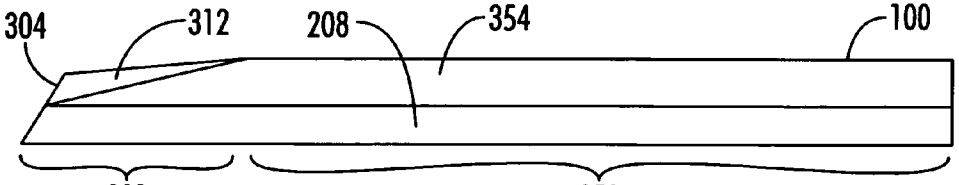
FIG. 9 is a left side view of the planing pontoon hull.

As shown in FIG. 1 of the drawings, one exemplary embodiment of the present invention is generally shown as a pontoon boat 10 including multiple planing pontoon hulls 100 connected by a spanning deck 102. Because the components of a pontoon boat including power, steering, railing, awnings, and other items are well known in the art, these items have been deleted for clarity of the present invention. The present invention provides for the shallow water operation advantages of a pontoon hull with the efficient low speed displacement operation and adds high speed deep water planing capabilities without sacrificing the low speed shallow water advantages. Improved handling characteristics are provided by wide pontoon bottoms and simple construction and layout provide further assembly advantages of the present invention.

As shown in FIG. 1 of the drawings and further detailed in FIGS. 2 through 9, the upper hull block 200 is the supporting area and transition between the spanning deck 102 and the lower hull block 300. The upper hull block 200 includes a top 202 for connection to the spanning deck 102, or may use a portion of the lower spanning deck for structural rigidity of the design. The upper hull block includes an angled upper front 204, left upper side 206, right upper side 208, and upper back 210. The angles recite for the preferred embodiment of this invention are a product of the materials involved and the stepped lifting capacity of the pontoon that has been derived through testing. All of these angles are a product of the size of the pontoon and may increase incrementally with the width and height of the pontoon. They should remain within approximately plus or minus two degrees during the building process, even as size increases.

The angled upper front 204 is positioned at approximately a 58 degree angle A1 from the horizontal axis along the flat planing bottom 356 of the pontoon hull 100. This provides the docking shore approach angle to deflect the boat upward during contact of the hull with the shore to minimize damage to both the hull and the contacted item. The left upper side 206 and right upper side 208 overhang the lower hull block 300 and are connected with a left step transition 212 and right step transition 214 which serve to deflect water riding upward along the side of the lower hull block's 300 body section 350.

The lower hull block 300 is constructed from a bow section 302 and a body section 350. The bow section 302 includes a forward split edge 304 which is again positioned at approximately a 59 degree bow angle A1 from the horizontal axis along the flat planing bottom 356. The forward split edge 304 begins the sideways water displacement with the left displacement guide 310 and right displacement guide 312. The left and right displacement guides 310, 312 take off at approximately a twenty-two degree side displacement angle A4 from each other at the bottom of the forward split edge 304 evenly split on each side of the centerline of the pontoon hull 100. This provides for efficient low speed operation with water displacement to allow shallow water operation of the boat. These guides 310, 312 also provide enhanced directional control. This displacement angle A4 between the left and right displacement guides 310, 312 progressively increases to approximately a twenty degree angle at the bottom of the forward split edge 304. Between the left and right displacement guides 310, 312 and the corresponding lower left side 352 or lower right side 354 of the body section 350 are the left steep bow plane 306 and the right steep bow plane 308. The left steep bow plane 306 and the right steep bow plane 308 are positioned at approximately a 13 degree steep deflection angle A2 from the horizontal axis along the flat planing bottom 356. This steep angle provides for the initial lift of the front of the pontoon hull out of the water during acceleration of the boat. As the boat planes up at an angle, the effective upward thrust of these planes 306, 308 increases to provide increased lift at increased speeds with a simple to manufacture design. The bottom of the left and right displacement guides 310, 312 are connected to each other and the co-extending planing bottom 356 by the bottom shallow bow plane 314. The bottom shallow bow plane 314 is positioned at approximately a 5 degree shallow deflection angle A3 from the horizontal axis. This shallow angle provides for both a shallow rise for beaching purposes, and an approach angle that is gentle enough to start the front of the pontoon to rise as speed increases. This further encourages the boat to remain on plane in choppy water transitions during the high speed operation of the boat and provides contact locations to deflect the boat from objects in shallow water operations. Thus, shore or beach parking of the boat is enhanced in addition to the high speed advantages of this shallow plane bottom.

As noted by the previous references, the body section 350 is constructed from a lower left side 352, lower right side 354, co-extending planing bottom 356 and a lower back 358 to complete the overall shape of the planing pontoon 100. Note that the smooth surface of the co-extending planing bottom 356 and shallow approach angle of the bottom shallow bow plane 314 allow for shallow water operation of the planing pontoon hull without additional protrusions or other extensions that would tend to hang up the prior art pontoon designs. The hard chine transition between the planing bottom 356 and the sides 352, 354 further enhances directional control and stability of the pontoons. Also note that this construction provides for the large internal water displacement to continue to the forward bow of the pontoon hull 100 to maintain consistent floating support along the length of the pontoon to maximize weight carrying capabilities and minimize nose diving of the pontoon associated with prior art designs.

Reference numerals used throughout the detailed description and the drawings correspond to the following elements:

- Pontoon Boat 10
- Planing Pontoon Hull 100
- Spanning Deck 102
- Upper Hull Block 200
  - Top 202
  - Angled upper front 204
  - Left upper side 206
  - Right upper side 208
  - Upper Back 210
  - Left step transition 212
  - Right step transition 214
- Lower Hull Block 300
  - Bow section 302
    - Forward Split Edge 304
    - Left Steep bow plane 306
    - Right Steep bow Plane 308
    - Left displacement guide 310
    - Right displacement guide 312
    - Bottom shallow bow plane 314
  - Body section 350
    - Lower left side 352
    - Lower right side 354
    - Co-extending Planing bottom 356
    - Lower Back 358
- bow angle A1
- steep deflection angle A2
- shallow deflection angle A3
- side displacement angle A4

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining, ' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A boat apparatus for traveling across water, the boat apparatus comprising:

at least two lower extending displacement plane pontoon hulls connected to support a boat deck;

each pontoon hull including an upper hull block including an upper front, an upper left side, and an upper right side;

a lower hull block connected to the upper hull block, the lower hull block defining a bow section and a body section;

the body section including a back, a left side, and a right side connected by a planing bottom having a front edge;

the bow section including a steep bow plane and left and right displacement guides connected by a forward split edge extending downward from the steep bow plane to a shallow bow plane, the shallow bow plane extending back to the front edge of the planing bottom.

2. The apparatus of claim 1, the upper front mounted at a bow angle.

3. The apparatus of claim 2, the bow angle being substantially fifty-eight degrees from horizontal.

4. The apparatus of claim 1, the steep bow plane being mounted at a steep deflection angle of substantially thirteen degrees from horizontal.

5. The apparatus of claim 1, the shallow bow plane being mounted at a shallow deflection angle of substantially five degrees from horizontal.

6. The apparatus of claim 1, the displacement guides separating the steep bow plane into a left steep bow plane and a right steep bow plane.

7. The apparatus of claim 1, the left and right displacement guides being mounted at a side displacement angle of substantially twenty degrees from each other.

* * * * *